US005690503A

United States Patent [19]

Konda et al.

[11] Patent Number: 5,690,503

[45] Date of Patent: Nov. 25, 1997

[54] CONNECTOR LOCK STRUCTURE

[75] Inventors: Kazumoto Konda; Kunihiko Watanabe; Sho Miyazaki, all of Yokkaichi; Shigehiro Tsuda, Itami, all of Japan

[73] Assignees: Sumitomo Wiring Systems, Ltd., Mie; Asahi Metal Industries, Ltd., Hyogo, both of Japan

[21] Appl. No.: 710,142

[22] Filed: Sep. 13, 1996

[30] Foreign Application Priority Data

Sep. 20, 1995 [JP] Japan ..... 7-267728

[51] Int. Cl.[6] ..... H01R 4/50

[52] U.S. Cl. ..... 439/348

[58] Field of Search ..... 439/348, 350, 439/353, 355, 352

[56] References Cited

U.S. PATENT DOCUMENTS 3,684,321 8/1972 Hundhausen et al. ..... 439/353

4,166,664 9/1979 Herrmann .

4,939,339 7/1990 Folkening et al. .

OTHER PUBLICATIONS

Japanese Industrial Standard "Quick Coupling Unit for Gas Appliances" revised 1991–02–01; pp. 1–23.

*Primary Examiner*—Khiem Nguyen
*Assistant Examiner*—Yong Ki Kim
*Attorney, Agent, or Firm*—Oliff & Berridge

[57] ABSTRACT

A lock operating member 25 is mounted on a connector housing 21, and in this condition lock balls 35 are mounted one by one in respective ball support holes 24 while elastically displacing elastic engagement members 27 radially outwardly. The mounted lock balls 35 are held in the respective ball support holes 24 by the respective elastic engagement members 27, and therefore even if the posture of a female connector is changed, the operation can be carried out easily.

7 Claims, 4 Drawing Sheets

CONNECTOR LOCK STRUCTURE

BACKGROUND OF THE INVENTION

This invention relates to a structure for locking connectors together in a fitted condition.

For example, for charging an electric vehicle, there are used a vehicle body-side connector, connected to a car battery and fixed to a vehicle body, and a charger-side connector connected to a charger via a flexible cable. To start a charging operation, the charger-side connector is fitted in the vehicle body-side connector. In this case, in order to prevent the charger-side connector from disconnecting from the vehicle body-side connector during the charging operation, it is necessary to provide lock mechanism to hold the two connectors in the mutually fitted condition. In view of the strength reliability and the operability, it is proposed to use a ball lock mechanism, used in the connection of a gas pipe.

However, in such a ball lock mechanism, in order to provide a uniform engagement force in a circumferential direction, ball support holes are provided, for example, at four positions, respectively, which are circumferentially spaced 90 degrees from one another, and lock balls are received in these ball support holes, respectively. In a pre-assembled condition in which the lock balls are received respectively in the ball support holes, the ball support holes are open downwardly, and therefore there is a risk that the lock balls are removed from the respectively ball support holes. Therefore, some measures must be provided for preventing this, which results in a disadvantage that the assembling operation becomes cumbersome.

SUMMARY OF THE INVENTION

The present invention has been made in view of the above problem, and an object of the invention is to provide a connector lock structure in which lock balls can be easily mounted.

A connector lock structure of the invention comprises a tubular fitting portion formed on a connector housing for fitting relative to a mating connector; ball support holes which are formed through the tubular fitting portion, and are open to outer and inner peripheral surfaces of the tubular fitting portion; lock balls which are radially displaceably received respectively in the ball support holes, and are prevented from passing radially past that peripheral surface of the tubular fitting portion facing the mating connector, that portion of each of the lock balls, projecting from the peripheral surface of the tubular fitting portion, being engageable with the mating connector, thereby locking the two connectors in a mutually fitted condition; elastic engagement members each elastically displaceable radially between an engagement position where the elastic engagement member engages that side of the associated lock ball facing away from the mating connector and a retracted position where the associated lock ball is allowed to be disengaged from the mating connector; and a flexure restriction member for preventing the elastic engagement members from being elastically flexed into their retracted position.

In the invention of this structure, when the mating connector is fitted relative to the tubular fitting portion, so that the lock balls are engaged with the mating connector, the elastic engagement members are prevented by the flexure restriction member from being displaced into the retracted position, and therefore the two connectors are locked together in a mutually fitted condition. When the elastic engagement members are displaced into their retracted position, the lock balls are displaced to be disengaged from the mating connector, thereby releasing the locking between the two connectors.

Where the plurality of ball support holes are provided in circumferentially-spaced relation, the lock balls are mounted one by one in the respective ball support holes while elastically flexing the elastic engagement members into the retracted position. At this time, the mounted lock balls are held in the respective ball support holes by the respective elastic engagement members engaging the respective lock balls.

In the invention, the elastic engagement members are movable in a direction of fitting of the mating connector between a lock position where the elastic engagement members are prevented by the flexure restriction member from being elastically displaced into the retracted position and a lock release position where the elastic engagement members are allowed to be displaced into the retracted position.

In the invention of this structure, when the mating connector is fitted relative to the tubular fitting portion, so that the lock balls are engaged with the mating connector, the elastic engagement members are moved into the lock position, and are prevented by the flexure restriction member from being displaced into the retracted position, thereby locking the two connectors together. When the elastic engagement members are moved into the lock release position, the lock balls are displaced to be disengaged from the mating connector, thereby releasing the locking between the two connectors.

Where the plurality of ball support holes are provided in circumferentially-spaced relation, the lock balls are mounted one by one in the respective ball support holes while elastically flexing the elastic engagement members, mounted in the lock position, into the retracted position. At this time, the mounted lock balls are held in the respective ball support holes by the elastic pushing force applied by the elastic engagement members.

In the invention, each of the ball support holes is narrow and elongate in the direction of fitting of the mating connector, and each of the elastic engagement members has a ball push portion for pushing the associated lock ball, received in the ball support hole, toward the lock position, and the elastic engagement members are urged toward the lock position by a lock spring.

In the invention of this structure, the mating connector, fitted relative to the tubular fitting portion, abuts against the lock balls, and moves the elastic engagement members toward the lock release position against the bias of the lock spring. When the elastic engagement members are brought out of registry with the flexure restriction member, and are displaced into the retracted position, the lock balls are displaced to be disengaged from the mating connector. Then, when the lock balls are engaged with the mating connector, the elastic engagement members and the lock balls are moved into the lock position under the influence of the lock spring, and the elastic engagement members are prevented from being displaced into the retracted position, thereby holding the two connectors in the locked condition.

When mounting the lock balls in the respective ball support holes, the elastic engagement members are held in the lock position under the influence of the lock spring, and the lock balls are pushed by the respective ball push portions, and therefore the mounted lock balls will not move in the respective ball support holes, and hence will not be disengaged from the respective elastic engagement members.

According to the invention as mentioned above, when mounting the lock balls, the mounted lock balls are held in the respective ball support holes by the respective elastic engagement members engaging the respective lock balls, and therefore even if the plurality of lock balls are arranged in circumferentially-spaced relation, the mounting of the lock balls can be carried out easily.

DETAILED DESCRIPTION OF PREFERRED EMBODIMENTS

Figure 1:
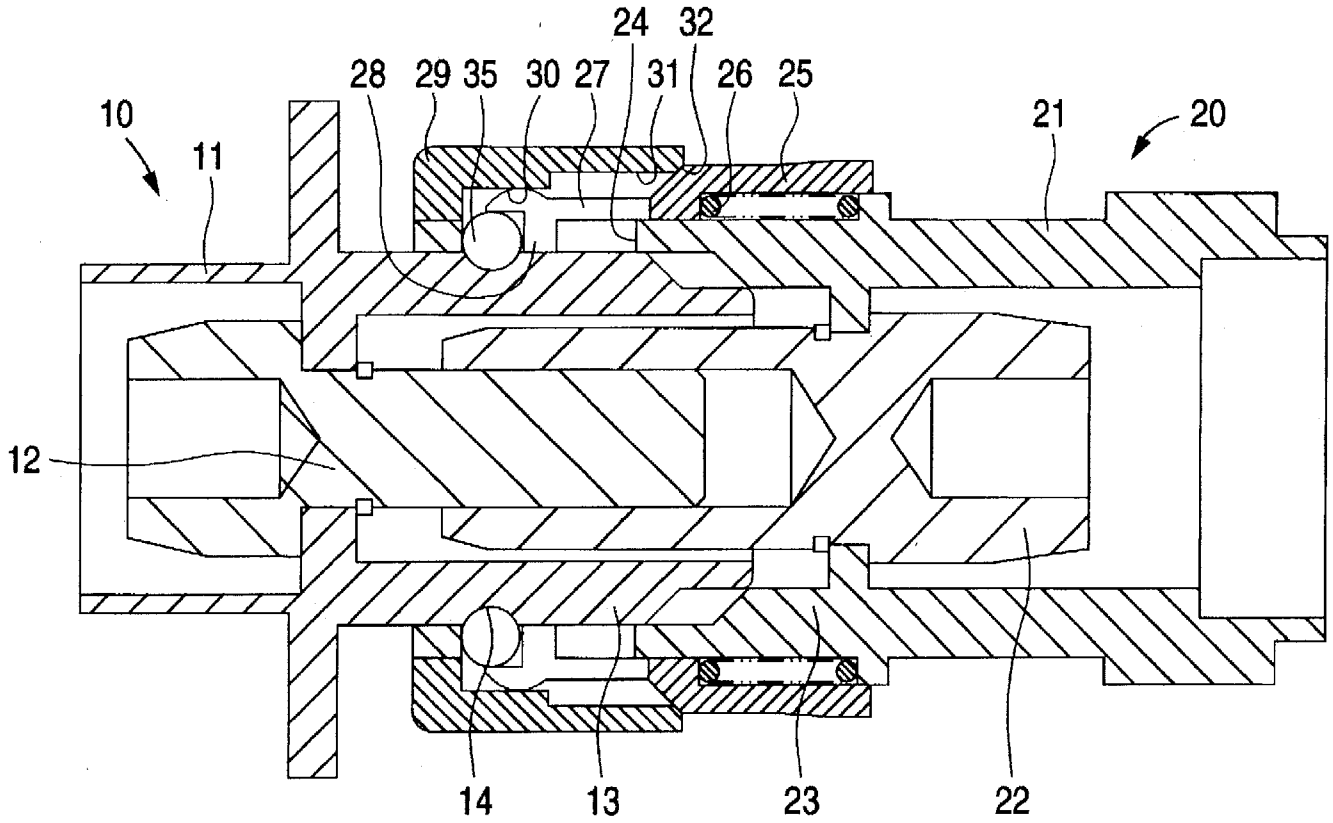
FIG. 1 is a cross-sectional view of one preferred embodiment of the present invention in a fitted condition.

One preferred embodiment of the present invention will now be described with reference to FIGS. 1 to 5.

A male connector 10 (mating connector which is a constituent element of the present invention) includes a connector housing 11 which has a tubular configuration as a whole, and a male terminal 12 received in this housing. An engagement groove 14, having an arcuate cross-section, is formed in an outer peripheral surface of a forwardly-extending hood portion 13 of the housing over an entire circumference thereof. Lock balls 35 of a female connector 20 (described later) are engaged in this engagement groove 14, and with this arrangement the male connector 10 and the female connector 20 can be locked together in a mutually fitted condition.

The female connector 20 includes a connector housing 21 which has a tubular configuration as a whole, and a female terminal 22 received in this housing. The hood portion 13 of the male connector 10 is fitted in a forwardly-extending, tubular fitting portion 23 of the female connector, with its outer peripheral surface corresponding to an inner peripheral surface of the tubular fitting portion 23. Ball support holes 24 are formed through the tubular fitting portion 23 between the inner and outer peripheral surfaces thereof, and are disposed respectively at four positions circumferentially spaced 90 degrees from one another, each of the ball support holes 24 being elongate in the axial direction.

Figure 5:
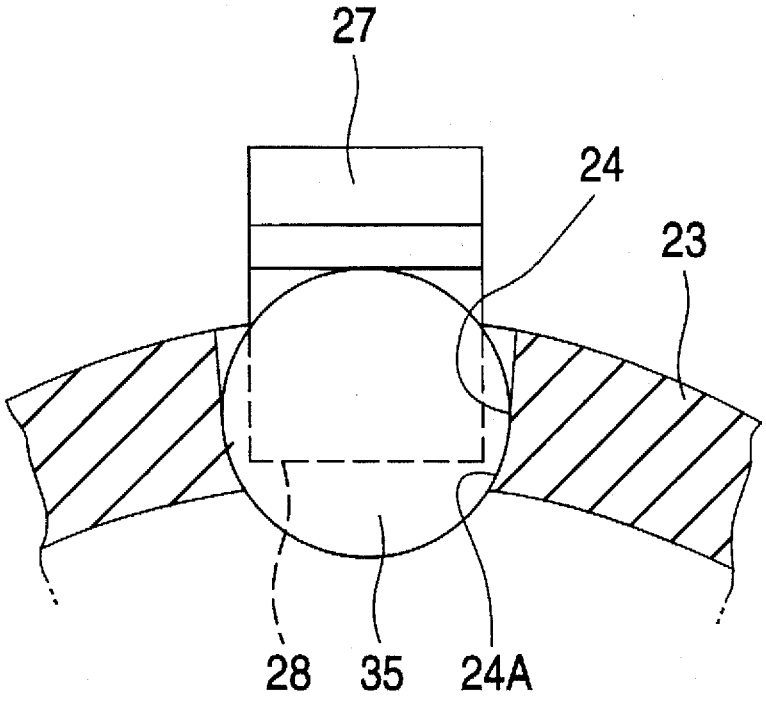
FIG. 5 is a fragmentary, transverse cross-sectional view showing the mounting of the lock ball.

With respect to the transverse cross-section of each ball support hole 24, those portions of opposite side surfaces of the ball support hole 24 adjacent to an inner opening edge 24A correspond to a surface shape of a lock ball 35 (described later) as shown in FIG. 5, and therefore the width of the ball support hole 24 is reduced at the inner opening edge 24A. With this arrangement, the lock ball 35 is prevented from being disengaged radially inwardly from the ball support hole 24. The other portion of the ball support hole 24 than that portion thereof adjacent to the inner opening edge 24A has a uniform width (which is equal to the outer diameter of the lock ball 35) up to an outer opening edge of the ball support hole 24.

The lock ball 35 has a spherical shape having a diameter lager than the thickness of the peripheral wall of the tubular fitting portion 23, and is put into the ball support hole 24 from the outer side. When the lock ball 35 is disposed most radially inwardly, part of the lock ball 35 projects inwardly beyond the inner periphery of the tubular fitting portion 23, and this projected portion is engaged in the engagement groove 14 in the male connector 10.

A lock operating member 25, having a tubular shape as a whole, is fitted on the outer periphery of the tubular fitting portion 23 for movement in the axial direction (that is, in a direction of fitting with the male connector 10). This lock operating member 25 is urged forwardly by a lock spring 26, and is normally held in a forward lock position (shown in FIG. 1) under the influence of the lock spring 26. However, the lock operating member 25 can be displaced into a lock release position (shown in FIG. 3) against the bias of the lock spring 26.

Four elongate, elastic engagement members 27 are formed integrally with the lock operating member 25, and extend forwardly respectively from those portions of its front edge corresponding respectively to the four ball support holes 24. The elastic engagement members 27 are arranged radially outwardly of the lock balls 25, and each of the elastic engagement members 27 can be radially elastically displaced between an engagement position (shown in FIG. 1) and a retracted position (shown in FIG. 2) disposed radially outwardly of this engagement position. When each elastic engagement member 27 is in the engagement position, the associated lock ball 35 is urged radially inwardly to project from the inner periphery of the tubular fitting portion 23. When each elastic engagement member 27 is in the retracted position, the associated lock ball 35 can be retracted into the ball support hole 24. A radially inwardly-projecting, ball push portion 28 is formed on each elastic engagement portion 27, and is disposed slightly rearwardly of the distal end thereof.

A flexure restriction member 29 of a tubular shape is fixedly mounted on the outer peripheral surface of the tubular fitting portion 23 at the front end portion thereof, and extends rearwardly in an overhanging manner. A front portion of the flexure restriction member 29, having a smaller inner diameter, serves as a limiting portion 30, and a rear portion thereof having a larger inner diameter serves as an allowing portion 31.

When the lock operating member 25 is in the lock position, the limiting portion 30 is in registry with the elastic engagement members 27, and the inner diameter of the limiting portion 30 is equal to a circle on which the outer surfaces of the elastic engagement members 27 lie. Therefore, when the lock operating member 25 is in the lock position, with the elastic engagement members 27 disposed in their engagement position, the limiting portion 30 prevents the elastic engagement members 27 from being displaced into their retracted position.

When the lock operating member 25 is in the lock release position, the allowing portion 31 is in registry with the elastic engagement members 27, and in this condition the elastic engagement members 27 can be elastically displaced into their retracted position.

A rear end of the flexure restriction member 29 serves as a stopper 32, and this stopper 32 prevents the lock operating member 25 from moving forwardly beyond the lock position.

Next, the operation of this embodiment will now be described.

When the female connector 20 is to be connected, the lock operating member 25 and the lock spring 26 are mounted on the outer periphery of the tubular fitting portion 23. In this condition, the lock operating member 25 is held in the lock position, and the front end portions of the ball support holes 24 are covered respectively with the elastic engagement members 27 disposed radially outwardly thereof. Then, in this condition, the elastic engagement members 27 are elastically displaced radially outwardly one by one, and the lock balls 35 are put in the respective ball support holes 24 one by one. At this time, the precedingly-mounted lock ball 35 is held in the front end portion of the ball support hole 24 by the elastic engagement member 27 and the ball push portion 28, and therefore even if the posture of the female connector 20 is changed, the lock ball 35 will not be disengaged from the ball support hole 24. Therefore, the mounting of the lock balls 35 can be carried out easily.

When the male connector 10 begins to fit in the female connector 20, the outer front edge of the hood portion 13 of the male connector 10 abuts against the lock balls 35, projecting radially inwardly from the inner periphery of the tubular fitting portion 23, and presses these lock balls 35. However, the lock balls 35 are urged radially inwardly by the respective elastic engagement members 27 prevented by the limiting portion 30 from radially-outward displacement, and therefore the lock balls 35 and the lock operating member 25 are pushed back in unison against the bias of the lock spring 26.

Figure 2:
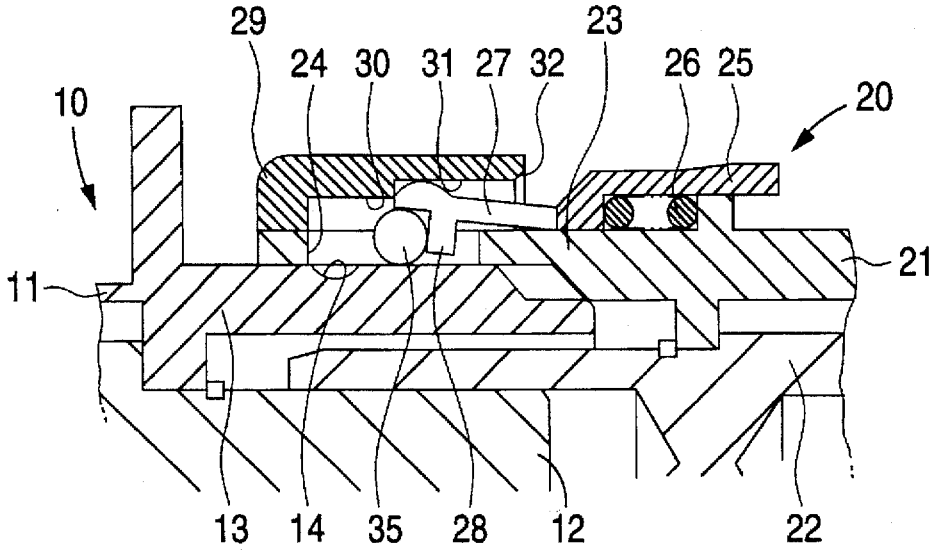
FIG. 2 is a fragmentary, cross-sectional view showing a condition in which an elastic engagement member is displaced into a retracted position.
Figure 3:
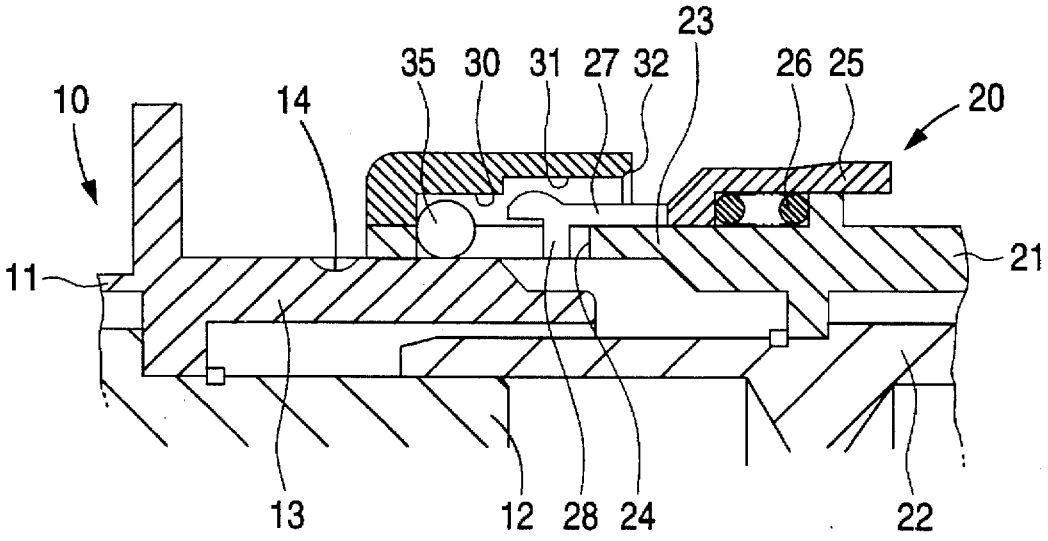
FIG. 3 is a fragmentary, cross-sectional view showing a condition in which the elastic engagement member is displaced into a lock release position.
Figure 4:
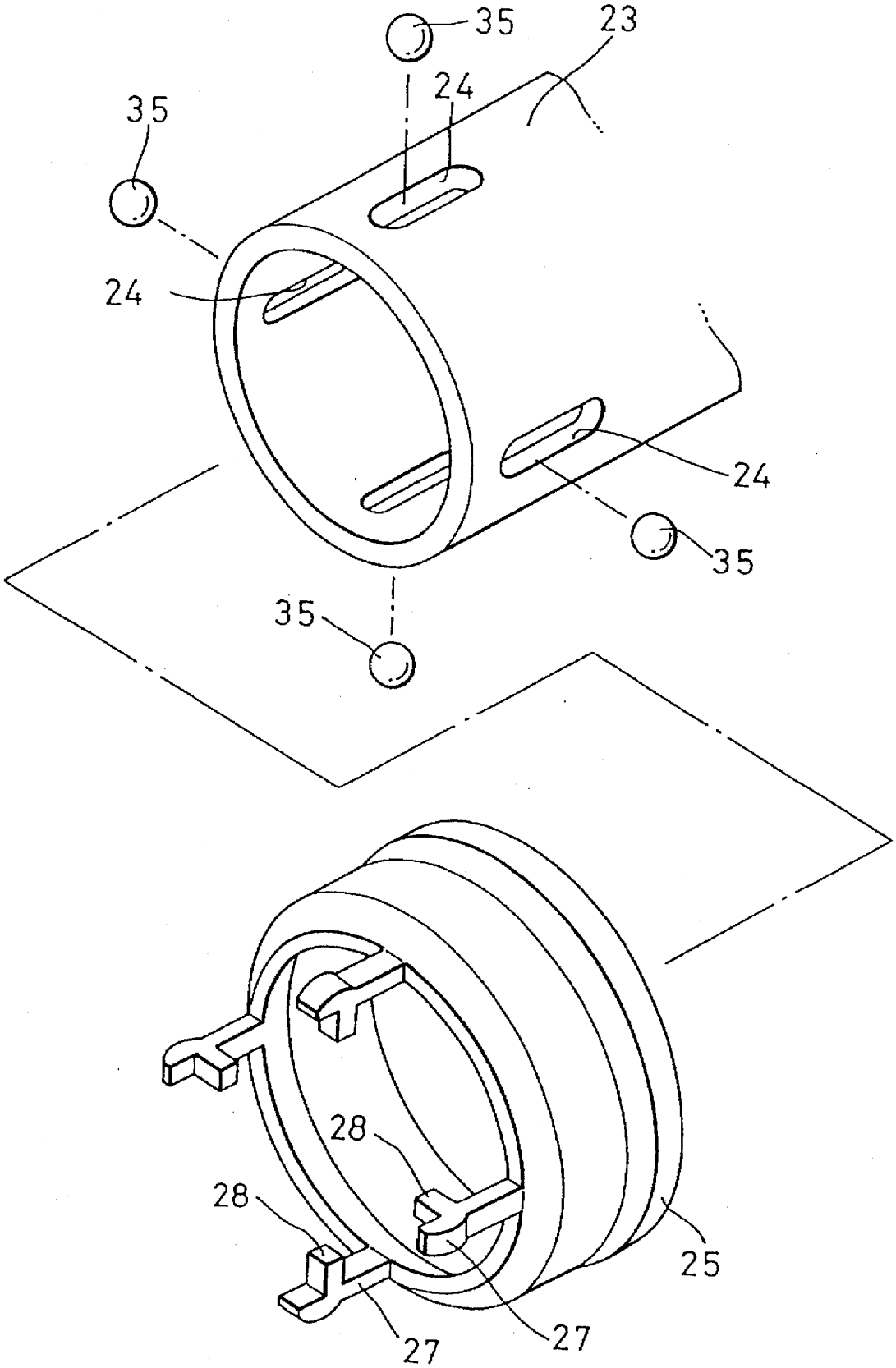
FIG. 4 is a fragmentary, perspective view showing the mounting of an lock operating member and lock balls.

Then, when the elastic engagement members 27 are shifted from the region, corresponding to the limiting portion 30, to the region corresponding to the allowing portion 31, the rearward movement of the lock operating member 25 is stopped, and the elastic engagement members 27 are elastically deformed radially outwardly, and the lock balls 35 are retracted into the respective ball support holes 24 (see FIG. 2). Thereafter, the two connectors 10 and 20 are fitted together, with the outer peripheral surface of the hood portion 13 held in contact with the lock balls 35.

Then, the two connectors 10 and 20 are fitted deep together, and the engagement groove 14 in the male connector 10 is brought into registry with the lock balls 35 whereupon the elastic engagement members 27 are elastically restored radially inwardly because of their elastic restoring force, and the lock balls 35 become engaged in the engagement groove 14. As a result, under the influence of the lock spring 26, the lock operating member 25 is moved forward, and also the male connector 10 is moved rearward relative to the female connector, and the fitting operation is completed when the lock operating member 25 reaches the lock position. At this time, since the elastic engagement members 27 are disposed in registry with the limiting portion 30, and therefore are prevented from being displaced radially outwardly, the engagement of the lock balls 35 in the engagement groove 14 is maintained, so that the fitted two connectors 10 and 20 are locked together against withdrawal.

For disengaging the two connectors 10 and 20 from each other, the lock operating member 25 is moved from the lock position into the lock release position, so that the elastic engagement members 27 are shifted from the limiting portion 30 to the allowing portion 31, thereby releasing the locking. Then, in this condition, the lock operating member 25 is held in the lock release position with the hand, and the two connectors 10 and 20 are moved away from each other. As a result, the lock balls 35 are displaced radially outwardly to be disengaged from the engagement groove 14, and the two connectors 10 and 20 are disengaged from each other through the process shown in FIG. 3.

As described above, even if the posture of the female connector 20 is changed when the female connector 20 is to be connected, the already-mounted lock ball or balls 35 are held in the respective ball support holes 24 by the respective elastic engagement members 27, and therefore though the lock balls 35 are arranged respectively in the four positions circumferentially spaced from one another, the mounting of the lock balls can be carried out easily.

The present invention is not to be limited to the above description and the drawings, and for example, the following embodiments fall within the scope of the present invention. Further, other modifications than the following can be made without departing from the scope of the invention.

In the above embodiment, although the elastic engagement members are engaged with the mating connector from the outer periphery side, there may be provided such a structure that elastic engagement members are engaged with the mating connector from the inner periphery side.

In the above embodiment, although there is provided the lock spring, the provision of the lock spring may be omitted, in which case the lock operating member is moved manually.

In the above embodiment, although the flexure restriction member is fixed while the lock operating member is movable, there may be provided such a structure that the lock operating member is fixed while the flexure restriction member is movable.

What is claimed is:

1. A connector lock structure comprising:

a tubular fitting portion formed on a connector housing for fitting relative to a mating connector;

at least one ball support hole formed through said tubular fitting portion, which are open to outer and inner peripheral surfaces of said tubular fitting portion;

at least one lock ball received in said ball support hole in a manner that said lock ball is displaceable in a radial direction of the tubular fitting portion, and is prevented from passing radially past that peripheral surface of said tubular fitting portion facing said mating connector, a projecting portion of said lock ball, projecting from the peripheral surface of said tubular fitting portion, being engageable with said mating connector, thereby locking the two connectors in a mutually fitted condition;

elastic engagement members each elastically displaceable radially between an engagement position where said elastic engagement member engages that side of the associated lock ball facing away from said mating connector and a retracted position where the associated lock ball is allowed to be disengaged from said mating connector; and a flexure restriction member for preventing said elastic engagement members from being elastically flexed into their retracted position.

2. A connector lock structure according to claim 1, wherein said elastic engagement members are movable in a direction of fitting of said mating connector between a lock position where said elastic engagement members are prevented by said flexure restriction member from being elastically displaced into said retracted position and a lock release position where said elastic engagement members are allowed to be displaced into said retracted position.

3. A connector lock structure according to claim 2, wherein each of said ball support holes is narrow and elongate in the direction of fitting of said mating connector, and each of said elastic engagement members has a ball push portion for pushing the associated lock ball, received in said ball support hole, toward said lock position, and said elastic engagement members are urged toward said lock position by a lock spring.

4. A connector lock structure according to claim 1, in which a plurality of ball support holes are formed through said tubular fitting portion.

5. A connector lock structure according to claim 1, wherein said ball support hole has a transverse cross section corresponding to a shape of said lock ball.

6. A connector lock structure according to claim 1, wherein said flexure restriction member includes a restricting portion having a first inner diameter and a allowing portion having a second inner diameter larger than said first inner diameter.

7. A connector lock structure according to claim 6, wherein said first diameter of said restricting portion is equal to an outer diameter of said elastic engagement members.

* * * * *